United States Patent [19]

Baxter

[11] 4,334,831

[45] Jun. 15, 1982

[54] ROTARY FUEL INJECTION PUMP

[75] Inventor: Leonard N. Baxter, Windsor, Conn.

[73] Assignee: Stanadyne, Inc., Windsor, Conn.

[21] Appl. No.: 127,322

[22] Filed: Mar. 5, 1980

[51] Int. Cl.[3] ..... F04B 1/10; F04B 19/02

[52] U.S. Cl. ..... 417/214; 417/462

[58] Field of Search ..... 123/504; 417/214, 221, 417/462

[56] References Cited

U.S. PATENT DOCUMENTS 3,000,318 9/1961 Volossevich ..... 417/462 X
3,046,905 7/1962 Davis ..... 417/462 X
3,847,509 11/1974 Bonin ..... 417/462 X
3,883,270 5/1975 Baxter ..... 417/214
4,225,291 9/1980 Bouwkamp et al. ..... 417/462 X

*Primary Examiner*—Michael Koczo, Jr.
*Attorney, Agent, or Firm*—Prutzman, Kalb, Chilton & Alix

[57] ABSTRACT

A rotary fuel injection pump with pump plunger stroke regulating means provided by an axially adjustable abutment slide for each plunger for limiting its outward stroke in accordance with the axial position of the abutment slide established by the angular position of a control ring.

9 Claims, 5 Drawing Figures

ROTARY FUEL INJECTION PUMP

TECHNICAL FIELD & DISCLOSURE OF INVENTION

The present invention relates generally to rotary fuel injection pumps of the type employed for delivering discrete measured charges of liquid fuel to an associated internal combustion engine of the compression-ignition type and more particularly to a new and improved pump plunger displacement control mechanism of the type disclosed in U.S. Pat. No. 3,883,270 of L. N. Baxter, dated May 13, 1975 and entitled "Fuel Pump" and operable for regulating the measured charges of fuel delivered by the pump.

A principal object of this invention is to provide a new and improved fuel injection pump wherein the measured charges of fuel sequentially delivered to the engine are regulated by the control of the pump plunger displacement or travel.

Another object of this invention is to provide in a fuel injection pump, a new and improved pump plunger displacement control mechanism which offers the advantages of more accurate and even charging, improved versatility of fuel control under all operating conditions, and a lower manufacturing cost.

Other objects will be in part obvious and in part pointed out more in detail hereinafter.

A better understanding of the invention will be obtained from the following detailed description and the accompanying drawings of an illustrative application of the invention.

BEST MODE FOR CARRYING OUT THE INVENTION

Figure 1:
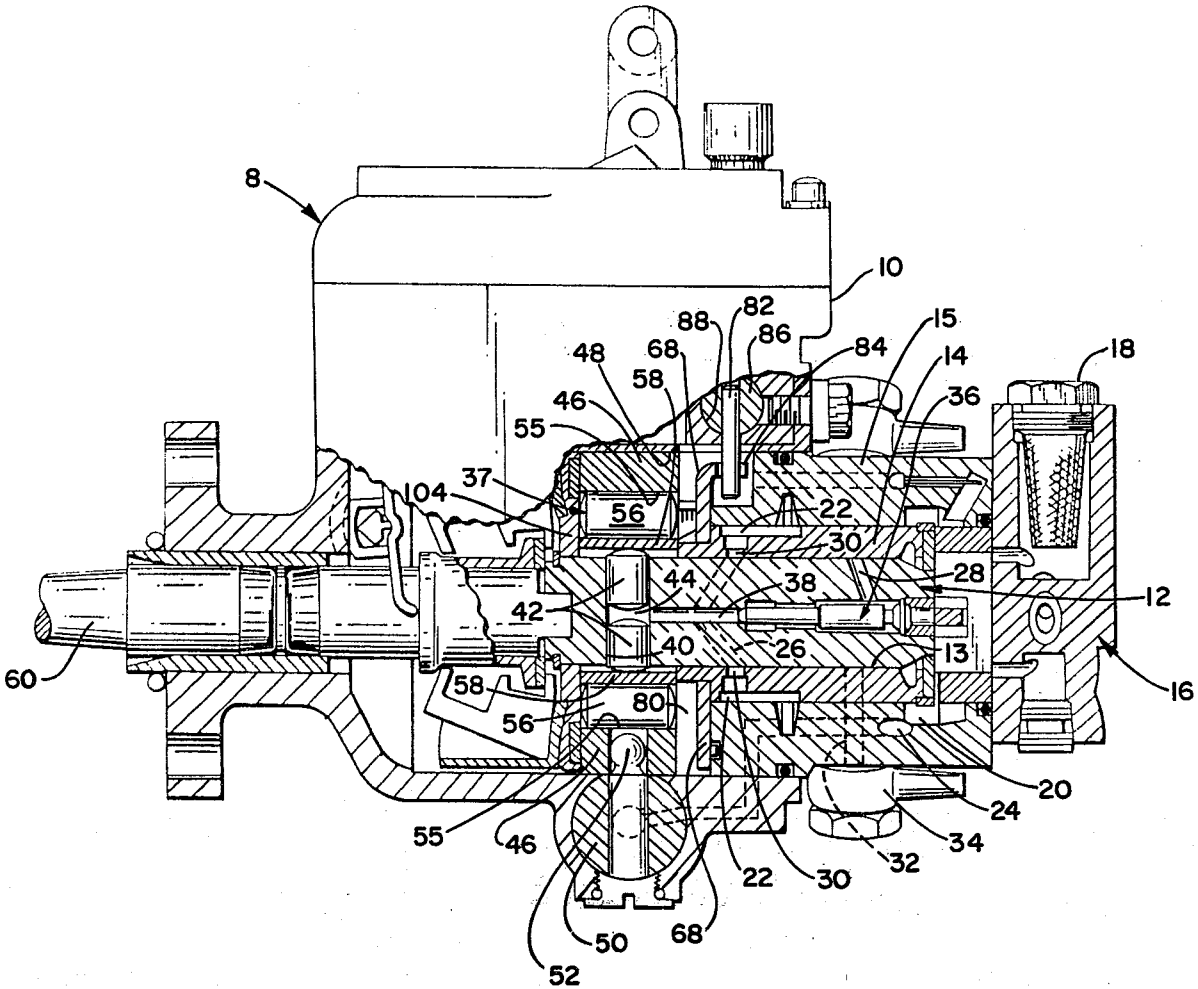
FIG. 1 is a side elevational view, partly broken away and partly in section, of a rotary fuel injection pump incorporating an embodiment of the present invention.

Referring to the drawings, an exemplary rotary fuel injection pump 8 of the type commercially used for supplying discrete measured charges of liquid fuel to an associated compression-ignition engine is shown incorporating an embodiment of the present invention. The pump includes a housing 10 and a rotor 12 journaled in a bore 13 of a fuel distributor sleeve 14 which is sealed within a bore of a hydraulic distributor head 15 mounted within the pump housing 10.

Mounted at one end of the rotor 12 for rotation therewith is a low pressure or transfer pump 16 having an inlet 18 to which fuel is supplied from a supply tank (not shown). The outlet 20 of the transfer pump 16 is connected via passage 24 to an annulus 22 in the sleeve 14.

The rotor 12 has a fuel inlet passage 26 and a fuel discharge passage 28. As the rotor 12 turns, the inlet passage 26 of the rotor 12 registers sequentially with a plurality of radial ports 30 (only two of which are shown) uniformly spaced around the sleeve 14 in a plane of rotation of the inlet passage 26 to provide periodic communication between the annulus 22 and the passage 26 for supplying fuel to the rotor 12. The discharge passage 28 similarly communicates sequentially with a plurality of ports 32 (only one of which is shown) uniformly spaced around the sleeve 14 in the plane of rotation of the discharge passage 28. As the rotor 12 turns, the discharge passage 28 sequentially discharges pressurized fuel charges from the rotor to a plurality of fuel connectors 34 for delivery of the fuel charges to the cylinders of an associated engine (not shown). A delivery valve 36 located in an axial passage 38 in the rotor 12 controls the backflow of pressurized fuel from the discharge passage 28.

The rotor 12 has an enlarged generally cylindrical body 39 with a plurality of diametral bores 40 each of which mounts a pair of diametrically opposed plungers 42 for radial reciprocation therein. The space between the inner ends of the plungers 42 forms a high pressure pump chamber 44 connected to the inlet passage 26 and the discharge passage 28 by the axial passage 38 to alternately receive and discharge fuel as the rotor 12 turns.

Surrounding the plungers 42 in their plane of revolution is a generally circular cam ring 46. The cam ring 46 is mounted in a bore 48 of the housing 10 for limited angular movement and its angular position is controlled by a timing piston 50 operatively connected thereto by a connector 52 extending into a radial bore 54 of the cam ring 46.

The cam ring 46 has an inner annular cam surface 55 with a plurality of inwardly projecting cam lobes (not shown) which are positioned to simultaneously actuate each pair of diametrically opposed plungers 42 inwardly. For that purpose, a roller assembly comprising a roller 56 and a roller shoe 58 is disposed between each plunger 42 and the cam ring 46 so that the rollers 56 act as cam followers for translating the cam contour into reciprocable movement of the opposed plungers 42.

In operation, as the rotor 12 is driven by the engine via a drive shaft 60, low pressure fuel from the transfer pump 16 is delivered through a port 30 to the rotor inlet passage 26 to the pump chamber 44, it being understood that each pair of opposed rollers 56 are angularly disposed with respect to the cam lobes (not shown) of the cam ring 46 to permit the plungers 42 to move radially outwardly in synchronism with registry of the inlet passage 26 with each port 30 for fuel to enter the chamber 44. As the rotor 12 continues to turn, the inlet passage 26 moves out of registry with the port 30 and the plunger actuating rollers 56 roll up leading surfaces (not shown) of the cam lobes (not shown) to power the plungers 42 inwardly and pressurize a charge of fuel in the pump chamber 44 to a high pressure. At this time the discharge passage 28 rotates into registry with a delivery port 32 connected to one of the cylinders of the engine for injection of a charge of fuel thereto under high pressure.

Continued rotation of the rotor repeats the process for sequential delivery of a charge of fuel to each cylinder of an associated engine in timed relation therewith.

Because of the essentially unrestricted flow of fuel from the transfer pump 16 to the pump chamber 44 during the pump intake interval, the pump chamber 44 is charged with fuel under a positive pressure, thereby eliminating any possible fuel vaporization problems that could result if the charge chamber 44 were filled under reduced pressure.

According to the present invention, positive mechanical means is provided for regulating the quantity of fuel injected during each pumping stroke without dumping any of the fuel pressurized in the pump chamber 44. This is accomplished by the use of a new and improved mechanical control mechanism which regulates plunger displacement and thereby regulates the quantity of fuel injected during each pumping stroke.

Figure 5:
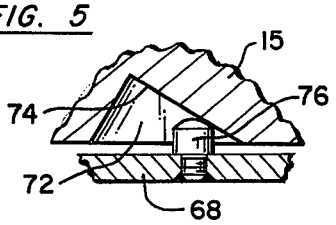
FIG. 5 is an enalarged partial longitudinal section view, partly broken away and partly in section, showing a cam and follower adjustment device of the rotary fuel injection pump.
Figure 4:
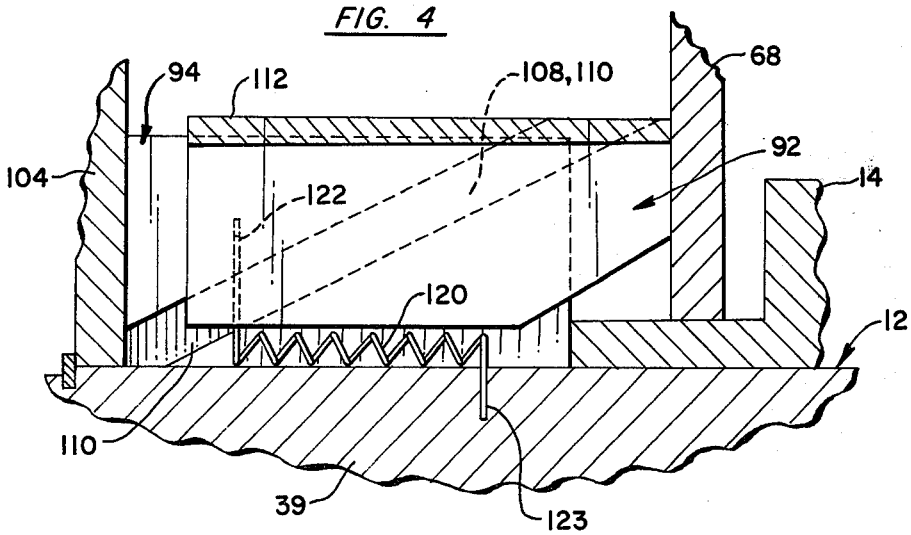
FIG. 4 is an enlarged partial longitudinal section view, partly broken away and partly in section, of the fuel injection pump taken generally along line 4—4 of FIG. 3.

Referring to FIGS. 1, 4 and 5, a control ring 68 is rotatably mounted on the fuel distributor sleeve 14 between the enlarged pump body 39 of the rotor 12 and an adjacent inner end of the hydraulic distributor head 15. The adjacent inner end of the distributor head 15 is provided with three equiangularly spaced recesses 72 (FIG. 5) having axially facing circumferentially inclined surfaces 74 which are engagable with similarly spaced followers or reaction buttons 76 mounted on the control ring 68.

The control ring 68 is spaced from the enlarged pump body 39 of the rotor by a gap 80 and, as will be readily apparent, rotation of the control ring 68 will shift the point of contact of the reaction buttons 76 along the inclined surfaces 74 to shift the control ring 68 axially.

The angular position of the control ring 68 is controlled via a connector 82 received in a notch 84 of the ring 68. The connector 82 is operatively driven by a plunger 86 mounted in a transverse bore 88. The axial position of the plunger 86 in its bore 88 may be controlled by one or more control mechanisms (not shown) for controlling the operation of the fuel pump. As will become apparent hereinafter, the plunger 86, by controlling the angular position of the control ring 68, establishes the outward limit of travel of the pump plungers 42 and therefore the charge of fuel delivered by the pump during each pumping stroke.

Figure 2:
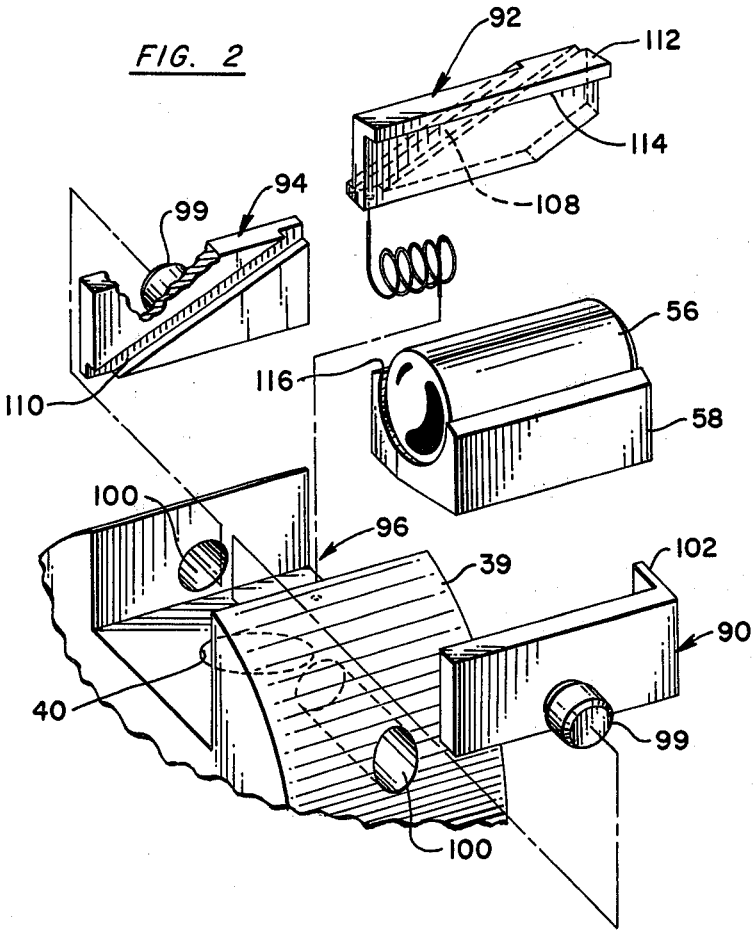
FIG. 2 is an enlarged partial exploded perspective view, partly broken away and partly in section, of a pump rotor of the fuel injection pump.
Figure 3:
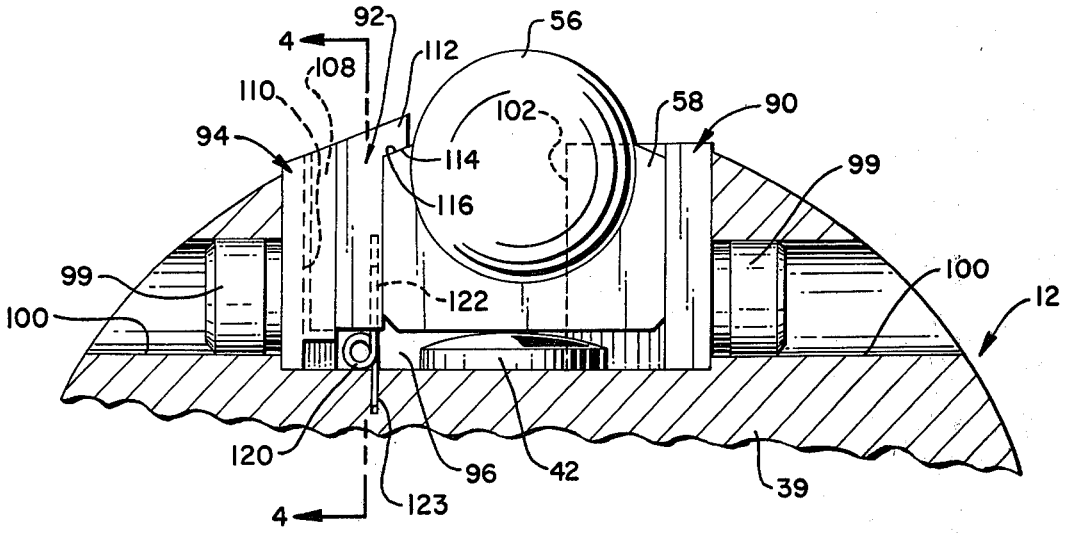
FIG. 3 is an enlarged partial transverse section view, partly broken away and partly in section, of the pump rotor.

Referring to FIGS. 2–4, each roller shoe 58 is mounted for sliding engagement between a fixed insert guide or bearing 90 on one side of the shoe 58 and an adjustable limit stop member or abutment slide 92 (which also functions as a guide bearing) on the opposite side of the shoe. Also, a fixed insert guide or bearing 94 is provided for supporting and guiding the adjustable limit stop member 92. The two opposed fixed rotor inserts 90, 94 are mounted within a saddle or channel 96 in the enlarged pump body 39 and have integral stub shafts 99 received within aligned transverse bores 100 in the pump body 39 for positively locating the inserts. The rotor insert 90 opposite the adjustable limit stop member 92 has a circumferentially projecting flange or lip 102 at one axial end thereof to hold the respective roller shoe 58 and roller 56 against axial displacement toward the control ring 68. All of the roller shoes 58 and rollers 56 are held against axial displacement in the opposite axial direction by a retaining ring 104 (FIGS. 1 and 4) and whereby the roller shoes 58 and rollers 56 are held in proper alignment with the pump plungers 42.

The limit stop member 92 and adjacent insert 94 have a slide connection which permits axial adjustment of limit stop member 92 relative to the adjacent roller shoe 58. In the illustrated example, the slide connection comprises an elongated lip or rail 108 on the limit stop member 92 received within a slot 110 in the adjacent insert 94 which is inclined to the axis of the rotor 12 at for example 26° to provide for adjusting the stop member 92 radially by axial adjustment thereof. The limit stop member 92 has an outer circumferentially projecting and axially extending elongated abutment lip 112 with a tapered inner edge 114 (FIG. 3) conforming to and engagable by a corresponding chamfered axial abutment edge 116 of the roller shoe 58. Accordingly, in each axial position of the limit stop member 92, its outer lip 112 is radially positioned to abut and thereby limit the outward displacement of the roller shoe 58 and respective pump plunger 42. As an alternative to the design shown, the limit stop member 92 could be mounted for axial reciprocation parallel to the rotor axis and have an elongated abutment lip 112 inclined to the rotor axis and engageable by a corresponding inclined abutment edge 116 of the roller shoe to adjust the outward limit of the respective pump plunger 42 by adjustment of the axial position of the limit stop member 92.

Referring to FIGS. 3 and 4, a coil tension spring 120 is mounted below the inner edge of the limit stop member 92, and the tension spring, aided by the centrifugal force on the limit stop member 92, maintains the limit stop member 92 in engagement with the control ring 68. The tension spring 120 has radially extending ends 122, 123 received within corresponding axially spaced bores in the pump body 39 and the limit stop member 92 and relatively axially located to place the spring 120 under tension. Also, the tension spring 120 is sufficiently flexible to permit the stop member 92 to slide easily along the inclined axis provided by the slide connection 108, 110 and whereby the limit stop member 92 is freely axially adjusted by the control ring 68. Thus, angular adjustment and corresponding axial adjustment of the control ring 68 provides for adjusting the outward stroke of the pumping plungers 42 to control the charge delivered by each pumping stroke.

The limit stop members 92 for all of the pump plungers 42 are simultaneously adjusted by the control ring 68 and so that for any angular setting of the control ring 68, the plurality of pairs of opposed pump plungers 42 provide for injecting equal charges of fuel into the cylinders of the associated engine.

Since outward movement of the roller shoes 58 is terminated by engagement of the roller shoes 58 with the limit stop members 92, and the impact force of each roller shoe 58 on the respective stop member 92 is proportional to the square of the velocity of their radial outward movement, gentle cam lobe slopes (not shown, but shown in the aforementioned U.S. Pat. No. 3,883,270) are preferably provided to slow the rate of outward radial movement of the roller shoes 58 to minimize the stress which would otherwise result from high velocity impact of each roller shoe 58 on its respective limit stop member 92.

From the foregoing, it is apparent that the present invention provides for the precise and positive mechanical control of the measured charges of fuel delivered by each pumping stroke without resort to reduced pressure feeding or dumping a portion of the fuel pressurized by the pump. Moreover, by controlling the axial position of a single control ring 68 by rotation of that ring, the invention provides versatility of control in a very simple and efficient manner.

As will be apparent to persons skilled in the art, various modifications, adaptations and variations of the foregoing specific disclosure can be made without departing from the teachings of the present invention.

I claim:

1. In a rotary fuel injection pump for an internal combustion engine having a housing with inlet and outlet passages; a rotor journaled in the housing having a rotor body with a plurality of angularly spaced radially extending bores and a fuel passage in communication with the inner ends of the bores having inlet and outlet ports which communicate alternately with said inlet and outlet passages during rotation of the rotor for alternately conducting fuel to and from the bores respectively, a plunger assembly for each bore comprising a pump plunger reciprocably mounted in the bore to sequentially receive charges of fuel from and deliver them to said inlet and outlet passages respectively, and a plunger operating roller and roller shoe at the outer end of the plunger; a cam ring with an inner cam contour surrounding the rotor in the plane of revolution of the rollers and engageable therewith to translate the cam contour into reciprocable movement of the plungers; and a plunger stroke limit mechanism for limiting the outward stroke of the plungers and thereby regulate the quantity of fuel injected during each inward pumping stroke thereof; the improvement wherein the plunger stroke limit mechanism comprises a separate abutment slide for each plunger assembly reciprocably mounted on the rotor for axial adjustment adjacent and relative to the respective plunger assembly and having first abutment means for limiting the outward stroke of the plunger assembly radially adjustable relative to the respective plunger assembly upon axial adjustment of the abutment slide, each plunger assembly having second abutment means engageable with the first abutment means of the respective abutment slide to adjustably limit the outward stroke of the respective plunger in relationship to said relative radial adjustment of the first abutment means and therefore the adjusted axial position of the respective abutment slide, and control means connected to axially adjust the abutment slides equally.

2. In a rotary fuel injection pump for an internal combustion engine having a housing; a rotor rotatable in the housing having a rotor body with a plurality of angularly spaced radially extending bores, a pump plunger reciprocably mounted in each bore to receive and then deliver a charge of fuel, and a plunger operating roller and roller shoe at the outer end of each plunger; a cam ring with an inner cam contour surrounding the rotor in the plane of revolution of the rollers and engageable therewith to translate the cam contour into reciprocable movement of the plungers, and a plunger stroke limit mechanism for limiting the outward stroke of the plunger and thereby regulate the quantity of fuel injected during each inward pumping stroke thereof; the improvement wherein the plunger stroke limit mechanism comprises a separate abutment slide for each plunger reciprocably mounted on the rotor on one side of the respective roller shoe for axial adjustment relative thereto and having first abutment means for limiting the outward stroke of the plunger radially adjustable relative to the respective roller shoe upon axial adjustment of the slide, each roller shoe having second abutment means engageable with the first abutment means of the respective abutment slide to adjustably limit the outward stroke of the roller shoe in relationship to said relative radial adjustment of the first abutment means and therefore the adjusted axial position of the abutment slide, and control means connected to axially adjust the abutment slides equally.

3. A rotary fuel injection pump according to claim 1 or 2 wherein each abutment slide is mounted on the rotor for adjustment along an axis inclined to the rotor axis for radial adjustment of the slide abutment means in conjunction with axial adjustment thereof.

4. A rotary fuel injection pump according to claim 1 or 2 wherein each abutment slide and the respective roller shoe have axially extending radially overlying and underlying edges respectively forming said first and second abutment means.

5. A rotary fuel injection pump according to claim 1 or 2 wherein the control means comprises a control ring coaxial with the rotor and engagable with the abutment slides for axial adjustment thereof and wherein the control ring and housing respectively have cooperating axially extending abutments and axially facing inclined surfaces engagable by the abutments for axial adjustment of the control ring upon angular adjustment thereof.

6. A rotary fuel injection pump according to claim 1 or 2 wherein the rotor body comprises an insert for each roller shoe mounted on one side of the respective roller shoe, wherein each abutment slide is reciprocably mounted between the respective rotor insert and roller shoe, and wherein the rotor insert and abutment slide have cooperating means establishing the axis of adjustment of the abutment slide.

7. A rotary fuel injection pump according to claim 1 or 2 wherein the rotor comprises a pair of first and second inserts on opposite sides of each roller shoe for respectively supporting the roller shoe and the respective abutment slide, and wherein each abutment slide is reciprocably mounted between the respective second insert and roller shoe.

8. A rotary fuel injection pump according to claim 3 wherein the abutment slide is mounted on the rotor body, and wherein the second abutment means is provided by the respective roller shoe.

9. A rotary fuel injection pump according to claim 1 or 2 wherein the stroke limit mechanism comprises slot and rail means for mounting the abutment slide for said axial adjustment.

* * * * *